United States Patent [19]

Anhalt et al.

[11] Patent Number: 4,919,626

[45] Date of Patent: Apr. 24, 1990

[54] CONNECTOR FOR IC CARD

[75] Inventors: John W. Anhalt, Orange; David S. Goodman, Mission Viejo, both of Calif.

[73] Assignee: ITT Corporation, New York, N.Y.

[21] Appl. No.: 338,030

[22] Filed: Apr. 14, 1989

[51] Int. Cl.[5] ..... H01R 13/15

[52] U.S. Cl. ..... 439/260; 439/59

[58] Field of Search ..... 439/188, 259, 260, 261, 439/263, 264, 267, 59

[56] References Cited

U.S. PATENT DOCUMENTS

| | | | |
|---|---|---|---|
| 2,857,577 | 10/1958 | Vanderpool | 439/260 X |
| 3,474,387 | 10/1969 | Krum et al. | 339/75 |
| 3,912,353 | 10/1975 | Kasuya et al. | 339/75 |
| 4,017,696 | 4/1977 | Falk | 179/175 |
| 4,542,950 | 9/1985 | Gillett et al. | 339/75 |
| 4,550,959 | 11/1985 | Grabbe et al. | 339/9 |
| 4,623,207 | 11/1986 | Sasaki et al. | 339/17 |
| 4,648,668 | 3/1987 | Sinisi | 339/74 |
| 4,776,803 | 10/1988 | Pretchel et al. | 439/59 |

*Primary Examiner*—Neil Abrams
*Assistant Examiner*—Khiem Nguyen
*Attorney, Agent, or Firm*—Thomas L. Peterson

[57] ABSTRACT

A connector for an IC memory card having a printed circuit member mounted within the housing of the card which extends into a slot opening at the edge of the card. The connector contains two rows of contacts which are engageable with conductive traces on the opposite sides of the printed circuit member when the card is inserted into the connector. The contacts in the connector are reversely bent to form inner arms joined to outer arms by nose portions. The inner arms of the contacts in the two rows are normally spaced apart a distance greater than the thickness of the printed circuit member so that when the card is initially inserted into the connector, the noses of the contacts will pass freely over the border of the printed circuit member. Thereafter, the sidewalls of the housing of the card cam the outer arms of the contacts inwardly, forcing the inner arms into engagement with the traces on the printed circuit member in the card.

4 Claims, 2 Drawing Sheets

FIG. 1
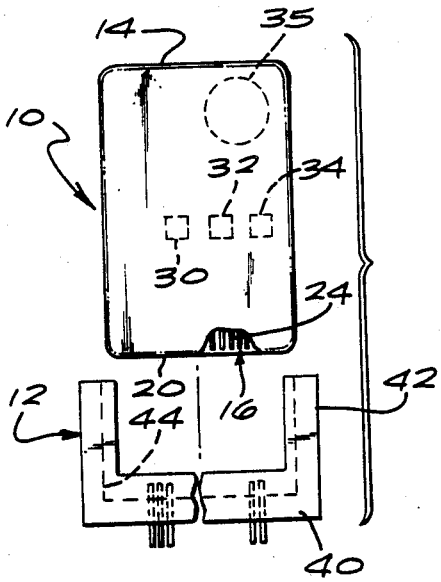
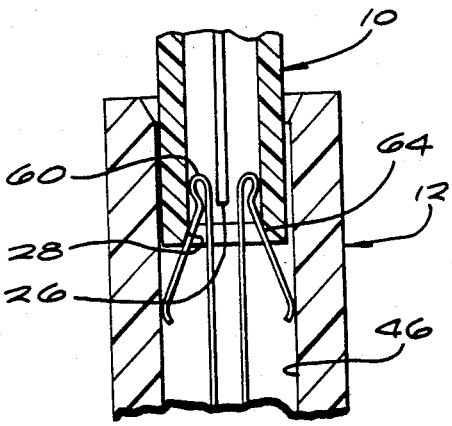
FIG. 4
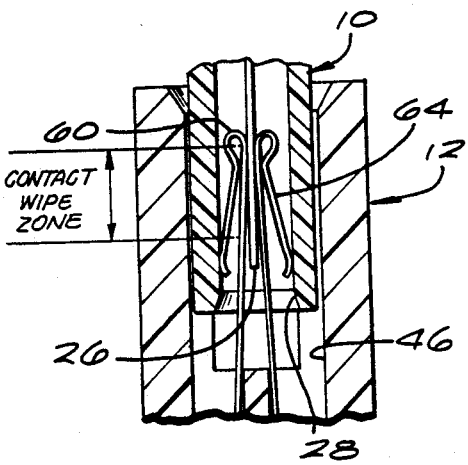
FIG. 5
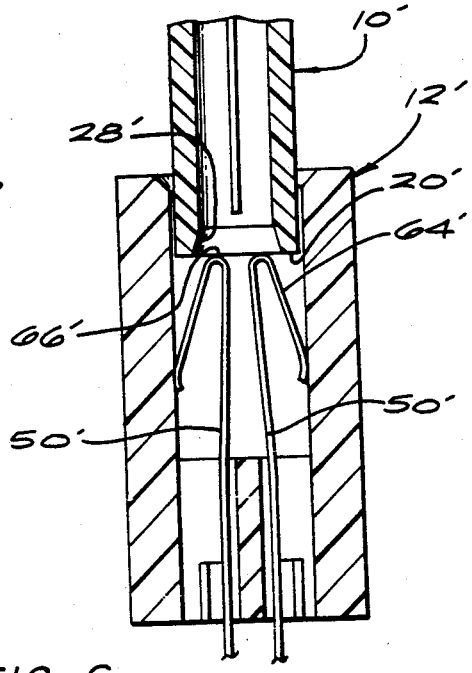
FIG. 6

CONNECTOR FOR IC CARD

CROSS-REFERENCE TO RELATED APPLICATIONS

This application is related to copendinq applications of I. Ohkubo, Ser. No. 296,175 filed Jan. 12, 1989, and Ser. No. 298,295 filed Jan. 17, 1989, each entitled "IC Card and Mating Socket," assigned to the same assignee as the present application.

BACKGROUND OF THE INVENTION

The present invention relates generally to an electrical connector and, more particularly, to a connector which is engageable with an IC card.

The aforementioned Ohkubo applications disclose an IC memory card and mating socket or connector in which the card has an edge along one of its sides formed with an elongated slot containing a Printed circuit member. The printed circuit member has rows of spaced conductive traces on its upper and lower surfaces along its exposed border. The conductive traces on the opposite sides of the printed circuit member are electrically interconnected to provide a double-sided, single read-out arrangement.

The mating connector disclosed in the aforementioned Ohkubo applications has a single row of contacts therein. The contacts extend upwardly into a channel opening at the upper surface of the connector housing. Each contact has a pair of spring arms which are spaced from the sidewalls of the connector housing. The spring arms diverge forwardly and inwardly to a point where they engage each other, and then are bent outwardly a short distance, forming a V-shaped gap for receiving the edge of the printed circuit member in the card. When the card is inserted into the connector, the sidewalls of the card housing slide into the open region between the contact arms and the connector sidewalls without engaging the contact arms. At the same time, the printed circuit member in the card enters the V-shaped gap formed at the front end of the sPring arms of the contacts, camming the arms apart until the arms ride over the edge of the printed circuit member onto the conductive traces thereon. By this arrangement, the spring arms of each contact are spread apart by the printed circuit member in the card so that the arms are biased into engagement with the conductive traces due to the inherent resilience of the arms.

While the foregoing arrangement is generally satisfactory, on occasion it has some deficiencies. Typically, the printed circuit member used in the aforementioned IC card is a very thin printed circuit board having a glass, epoxy or ceramic substrate which is quite fragile. When such a board is forced between the spring arms of the contacts in the Ohkubo connector, it is possible that the edge of the board may become damaged. Further, regardless of the form of printed circuit member used in the IC card, it is possible that engagement of the spring arms with the edge of the board can cause the conductive traces on the substrate to be peeled off, or delaminated. In addition, if the card utilizes a printed circuit member of any significant thickness and rigidity, it is possible that the edge of the substrate could wear off any plating such as gold, on the spring arms of the contacts when the card is inserted into the connector, therebY causing corrosion of the contacts and eventually a high resistance engagement between the contacts and the conductive traces on the board. Further, the prior art connector is not suitable for a double-sided, double read-out style contact/printed circuit member interface.

What is needed therefore and constitutes the object of the present invention is a connector for an IC card in which the contacts of the connector will not damage the printed circuit member in the card or themselves will not be impaired by the possible scraping of a plating on the contacts by the edge of the printed circuit member, yet the contacts in the connector will have a high engagement force with the conductive races on the printed circuit member.

Another object of the invention is to provide a connector for an IC card which permits a double-sided, double read-out contact/printed circuit member interface

SUMMARY OF THE INVENTION

According to a principal aspect of the present invention, there is provided a connector for an IC card of the type described herein above. The connector preferably contains two rows of contacts. Each contact has a spring portion which is reversely bent to form inner and outer arms joined by a nose portion. The inner arms of the contacts in the two rows are normally spaced apart a distance greater than the thickness of the printed circuit member in the IC card so that when the card is initiallY inserted into the connector, the nose portions of the contacts as well as the inner arms will pass freely over the edge of the printed circuit member in the card. Thereafter, the sidewalls of the card engage the outer arms of the contacts camming them inwardly, thereby causing the inner arms of the contacts to be urged into resilient engagement with the conductive traces on the opposite sides of the printed circuit member. Thus, the contacts do not engage the printed circuit member until the nose portions of the contacts clear the edge of the printed circuit member, thereby avoiding any damage to the printed circuit member substrate, or the conductive traces thereon and further avoiding the possible scraping of any plating on the contacts which could occur in the prior art connector. The engagement of the sidewalls of the card housing with the outer arms of the contacts forces the inner arms of the contacts into engagement with the conductive traces on the printed circuit member with a relatively high contact force, thereby assuring a reliable electrical connection therebetween. Furthermore, a relatively long wiping action occurs between the contacts and the conductive traces on the printed circuit member to assure a good electrical connection is obtained. Also, preferably the conductive traces on the opposite sides of the printed circuit member are electrically isolated from each other and are engaged by the two respective rows of contacts to provide a double-sided double read-out interface.

BRIEF DESCRIPTION OF THE DRAWINGS

FIG. 1 is an elevational view showing an IC card positioned to be inserted into the connector of the present invention;

FIG. 4 is a sectional view similar to FIG. 2 showing the IC card inserted further into the connector to a position where the sidewalls of the card housing initially engage the outer arms of the contacts in the connector;

FIG. 5 is a sectional view similar to FIGS. 2 and 4, showing the IC card fully inserted into the connector, whereupon the contacts are cammed inwardly into full engagement with the conductive traces on the opposite sides of the printed circuit member in the card and FIG. 6 is a vertical sectional view similar to FIG. 2 showing an alternative form of the connector of the present invention.

DESCRIPTION OF THE PREFERRED EMBODIMENTS

Figures 2, 3:
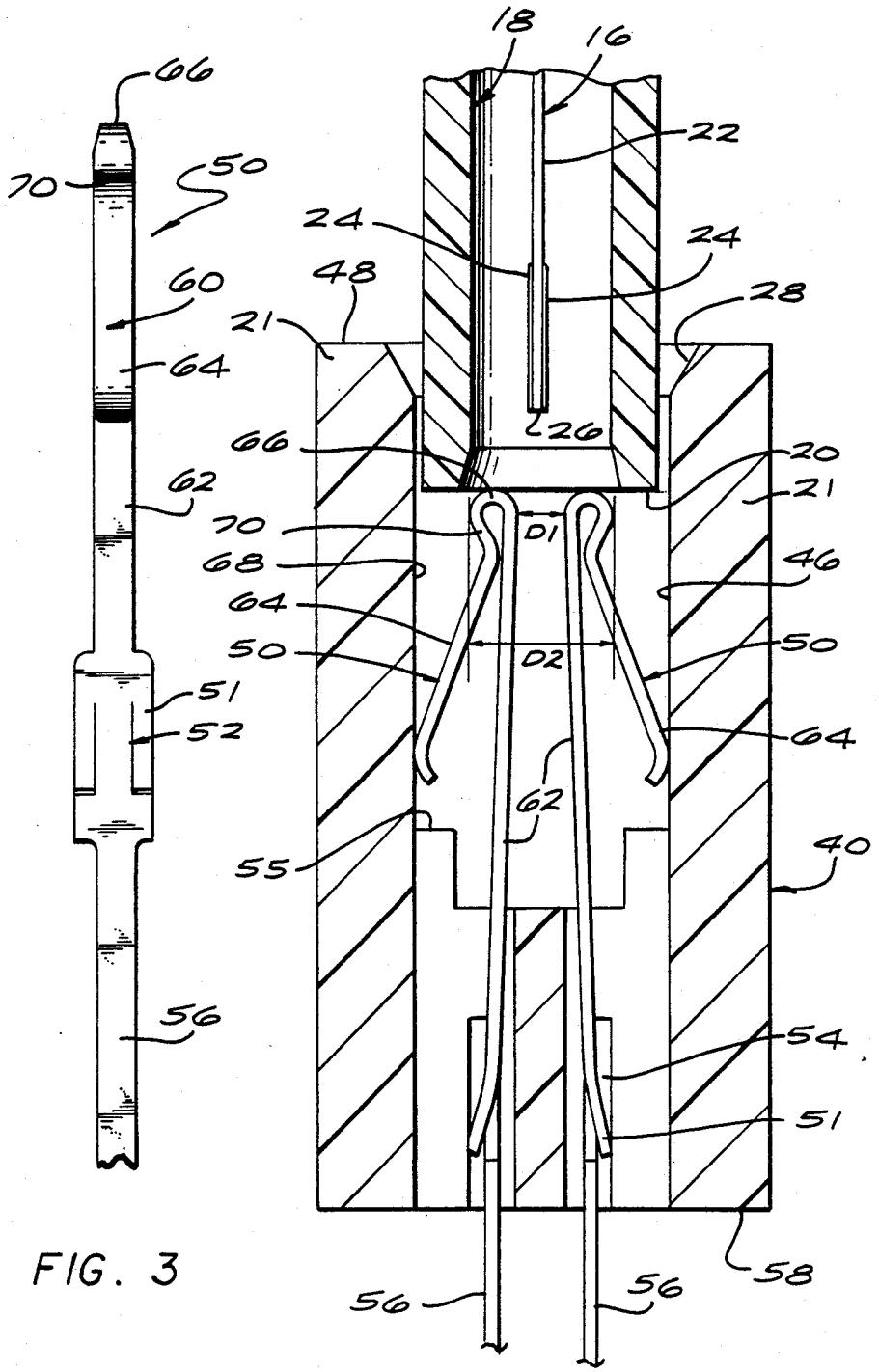
FIG. 2 is a vertical sectional view through the connector of the present invention showing a side portion of the IC card partially inserted into the connector to a position prior to the contacts in the connector being engaged by the sidewalls of the IC card housing.
FIG. 3 is a planned view of one of the contacts utilized in the connector shown in FIG. 2.

Referring now to the drawings in detail, FIG. 1 illustrates an IC memory card, generally designated 10, which is adapted to be mounted in the connector 12 of the present invention. The card may be similar to that disclosed in the aforementioned Ohkubo applications, and comprises a relatively thin rectangular housing 14 having a printed circuit member 16 mounted therein. The circuit member 13 extends into a slot 18 in the housing that opens at the edge 20 at one side of the housing, that side being the lower side illustrated in FIG. 1. The slot 18 defines housing sidewalls 21 which are spaced from the printed circuit member 16. To minimize the thickness of the IC card, preferably the printed circuit member 16 is a flexible printed circuit. However, the member 16 could also be a rigid printed circuit board if desired. In either case, conductive layers are formed on opposite sides of the substrate 22 of the printed circuit member. Preferably, rows of conductive traces 24, as seen in FIG. 1, are formed on the opposite surfaces of the substrate 22 of the printed circuit member 16 and are electrically isolated from each other. The traces in the respective rows are aligned with each other. Alternatively, one surface of the substrate could be formed with a conductive ground plane, rather than a plurality of conductive signal traces.

Preferably, the edge 26 of the printed circuit member 16 is spaced behind the edge 20 of the card housing so that it is protected from damage by handling of the card. Further, the sidewalls 21 of the card housing are beveled at 28 adjacent to the edge 20 of the housing which facilitates actuation of the contacts in the connector, as will be explained later herein.

As explained in the aforementioned Ohkubo applications, the printed circuit member 16 in the card 10 may have a CPU, a RAM, a ROM, and a battery mounted thereon, as shown in phantom at 30, 32, 34 and 35 in FIG. 1, which are suitably interconnected by circuitry (not shown) on the printed circuit member which extend to the conductive traces 24 along the edge of the printed circuit member.

As best seen in FIG. 1, the connector 12 comprises an insulative housing 40 having upstanding card guides 42 at its opposite ends formed with vertical slots 44 for guiding the card 10 into a channel 46 in the housing 40 which opens at its upper surface 48. Two rows of contacts 50 are mounted in the housing 40. Each contact has a mounting portion 52 which is mounted in the lower portion 54 of the housing 10. The lower portion 54 provides upwardly facing shoulders 55 forming the bottom of the channel 46, or a stop, against which the card 10 abuts when it is fully inserted into the connector. The contacts are retained in the housing by resilient retention tines 51. Each contact embodies a tail 56 which extends below the lower surface 58 of the housing 40, and an upper spring section 60 which extends upwardly into the channel 46 in the housing. The tails 56 of the contacts can be mounted in a printed circuit board, not shown.

The spring section 60 of each contact is reversely bent to form an inner arm 62 and an outer arm 64. The inner and outer arms are joined by a curved nose portion 66. The outer arms 64 of the contacts in each row extend rearwardly and outwardly toward the respective adjacent sides 68 of the channel 46. In the embodiment illustrated in FIGS. 2 to 5, the nose 66 of each contact is joined to the outer arm 64 by a short rearwardly and inwardly extending connecting segment 70.

The inner arms 62 of the contracts in the two rows of contacts are spaced apart a distance D1 which is greater than the thickness of the printed circuit member 16, that is, the thickness of the substrate 22 with the conductive traces 24 thereon, so that the contacts will be out of the path of the printed circuit member 16 when the card is inserted into the connector. By way of example only, the distance D1 should be a minimum of 0.030 inch when the thickness of the printed circuit member 16 is 005 inch. The spacing of the contacts by the distance D1 also provides an air gap between the contacts which prevents contact shorting prior to insertion of the card into the connector. The distance D2 between the outer surfaces of the curved end noses 66 of each pair of contacts is less than the width of the slot 18 in the card 10 so that when the card is initially inserted into the connector over the contacts, the forward portion of the contacts will move freely into the slot 18 in the card.

Reference is now made to FIGS. 2 4 and 5 which show the sequence of actuation of the contacts 50 when the card 10 is inserted into the connector 12. FIG. 2 shows the card initially inserted into the connector so that the edge 20 is even with the noses of the contacts 50. As the card is inserted further into the channel 46 in the connector, as shown in FIG. 4, the noses 66 of the contacts will freely enter into the forward portion of the slot 18 in the card until the beveled surfaces 28 on the sidewalls 21 of the card housing engage the outer arms 64 of the contacts. In this position, the contacts still have the same configuration as illustrated in FIG. 2 since they have not yet been deflected by the housing of the card and the inner arms of the contacts are still spaced from the printed circuit member 16 in the card, yet the noses of the contacts have passed beyond the edge 26 of the card. Thus, there is no engagement between the contacts and the edge of the card which could damage the substrate of the printed circuit member in the card, the conductors thereon, or cause a scrapping of any plating on the contacts.

As the card 10 is pushed further into the connector channel 46 to its final position illustrated in FIG. 5, the beveled surfaces 28 and sidewalls 21 of the card housing cam the outer arms 64 of the contacts inwardly toward each other, which causes the inner arms of the contacts to be brought into resilient enqagement with the conductors on the printed circuit member 16 in the card. This results in the contacts having a high engagement force over a substantial length of the conductive traces on the printed circuit member, which is indicated as being the "contact wipe zone" in FIG. 5.

Thus, by the present invention engagement of the contacts with the edge of the printed circuit member in the card is avoided, thus elementing any potential problem of damaging the substrate of the board or delaminating the conductive layers thereon upon matinq of the card with the connector. Further, by having the outer arms of the contacts actuated by the sidewalls 21 of the card housing to urge the inner arms of the contacts toward each other, a high contact force is achieved between the contacts and the conductive traces on the printed circuit member. Also, an excellent wiping action is achieved between the contacts and the conductive traces which will remove any film on the traces, such as an oxide film, thereby assuring a reliable electrical connection between the contacts and the traces.

Reference is now made to FIG. 6 of the drawings which shows an alternative form of the connector of the present invention. In this embodiment the basic structure is as previously described and like numbers primed are used to indicate like or corresponding parts. In FIG. 6, the outer arm 64' of each contact 50' extends immediately outwardly from the curved nose portion 66', rather than being connected thereto by an inwardly extending connecting segment, such as the segment 70 illustrated in FIGS. 2 to 5. As a result, when the card 10' is inserted into the connector 12', the beveled cam surfaces 28' on the card housing will engage the outer arm 64' of the contacts in a position closer to the noses of the contacts than in the embodiment of the invention illustrated in FIGS. 2 to 5. As a consequence, the forward ends of the contacts 50' in the connector 12' will engage the printed circuit member 16' at a shorter distance from the edge 20' thereof than in the first embodiment of the invention disclosed herein. Otherwise, the connector illustrated in FIG. 6 functions in the same manner as the connector illustrated in FIGS. 2 to 5.

While it is preferred that the card/connector contact interface be of the double-sided double read-out style as shown in the drawings, it would also be possible in accordance with the invention, to have traces on only one side of the printed circuit member in the IC card and only one row of contacts in the connector or electrically connected traces on both sides of the printed circuit member and a single row of contacts in the connector with each contact being formed with a pair of spring sections 60. Although several embodiments of the invention have been disclosed herein for purposes of illustration, it will be understood that various changes can be made in the form, details, arrangement, and proportions of the various parts in such embodiments without departing from the spirit and scope of the invention as defined by the appended claims.

What is claimed is:

1. A connector for receiving an IC card having an edge on a side of the card formed with an elongated slot containing a substrate having a row of spaced conductors thereon adjacent to the edge of the substrate, comprising:

an insulative housing having an upper surface and a lower surface, a channel in said housing opening at said upper surface and adapted to slidably receive therein the side of said card with its edge adjacent to the bottom of said channel;

a row of contacts mounted in said housing having spring sections spaced apart a distance corresponding to the spacing of the conductors on said card and extending upwardly into said channel for insertion into said slot;

each of said spring sections being reversely bent to form an inner arm and an outer arm joined by a nose portion;

said nose portion of each said contact being curved and joined to said outer arm by a relatively short inwardly and rearwardly extending connecting segment;

said inner arms being positioned in said channel so as to be out of the path of said substrate when the card is initially inserted into the connector;

said outer arms of said contacts extending toward one side of said channel; and said outer arms being engageable by the card to cam said outer arms, and hence said inner arms, inwardly into engagement with the conductors on the substrate, after said nose portions of said contacts pass a border region of the substrate adjacent to the edge of the substrate when the card is inserted into the connector.

2. A connector for receiving an IC card having an edge on a side of the card formed with an elongated slot containing a substrate having rows of spaced conductors on its opposite surfaces adjacent the edge of the substrate, comprising:

an insulative housing having an upper surface and a lower surface, a channel in said housing opening at said upper surface and adapted to slidably receive therein the side of said card with its edge adjacent to the bottom of said channel;

two rows of contacts mounted in said housing having spring sections spaced apart a distance corresponding to the spacing of the conductors on said card and extending upwardly into said channel for insertion into said slot;

each of said spring sections being reversely bent to form an inner arm and an outer arm joined by a nose portion;

said nose portion of each said contact being curved and joined to said outer arm by a relatively short inwardly and rearwardly extending connecting segment;

said inner arms of said contacts in said rows being spaced apart a distance greater than the thickness of the substrate and conductors thereon;

said outer arms of said contacts in each row extending toward the respective adjacent sides of said channel; and said outer arms of said contacts in said two rows being engageable by the card to cam said outer arms, and hence said inner arms, inwardly toward each other into engagement with the conductors on the opposite surfaces of the substrate after said nose portions of said contacts pass a border region of the substrate adjacent to the edge of the substrate when the card is inserted into the connector.

3. An IC card-connector combination comprising:

(a) an IC card having an edge on a side of the card formed with an elongated slot containing a substrate fixedly mounted in said card, said substrate having a row of spaced conductors thereon adjacent to the edge of the substrate, said slot defining spaced sidewalls;

(b) a connector comprising:

(i) an insulative housing having an upper surface and a lower surface, a channel in said housing opening at said upper surface and slidably receiving therein the side of said card with said edge adjacent to the bottom of said channel;

(ii) a row of contacts mounted in said housing having spring sections spaced apart a distance corresponding to the spacing of the conductors on said card and extending upwardly into said channel and said slot to engage said conductors on said substrate;

(iii) each of said spring sections being reversely bent to form an inner arm and an outer arm joined by a nose portion;

(iv) said inner arms being positioned in said channel so as to be out of the path of said substrate when said card is initially inserted into the connector;

(v) said outer arms of said contacts extending toward one side of said channel; and (vi) when said card is inserted into said connector, said outer arms of said contacts being engaged by said sidewalls of said card to cam said outer arms, and hence said inner arms, inwardly into engagement with the conductors on said substrate, after said nose portions of said contacts pass the substrate edge, said inner arms of said contacts having a wiping engagement with said conductors on said substrate after said nose portions of said contacts pass the substrate edge.

4. An IC card-connector combination comprising:

(a) an IC card comprising:

(i) a flat, relatively thin housing having an edge on a side of said housing;

(ii) a slot formed lengthwise in said edge forming a pair of spaced sidewalls;

(iii) a printed circuit member fixedly mounted in said housing;

(iv) said printed circuit member having a border region extending into said slot spaced from said sidewalls, said border region providing an edge and upper and lower surfaces;

(v) rows of spaced conductors on said upper and lower surfaces of said printed circuit member;

(b) a connector comprising:

(i) an insulative housing having a channel therein slidably receiving said sidewalls of said card housing;

(ii) two rows of contacts mounted in said connector housing having spring sections spaced apart a distance corresponding to the spacing of said conductors on said upper and lower surfaces, respectively, of said printed circuit member, said contacts extending into said channel and said slot to engage said conductors;

(iii) each of said spring sections being reversely bent to form an inner arm and an outer arm joined by a nose portion;

(iv) said inner arms of said contacts in said rows being spaced apart a distance greater than the thickness of said printed circuit member and said conductors thereon before said card is inserted into said connector;

(v) said outer arms of said contacts in each row extending toward the respective adjacent sides of said channel; and (vi) when said card is inserted into said connector, said outer arms of said contacts in said two rows being engaged by said sidewalls of said card housing to cam said outer arms, and hence said inner arms, inwardly toward each other into engagement with the conductors on the upper and lower surfaces of said printed circuit member after said nose portions of said contacts pass said printed circuit member edge, said inner arms of said contacts having a wiping engagement with said conductors on said substrate after said nose portions of said contacts pass the substrate edge.

* * * * *